US012668954B2

(12) United States Patent
Hashimoto et al.

(10) Patent No.: US 12,668,954 B2
(45) Date of Patent: Jun. 30, 2026

(54) BUCKET INFORMATION ACQUISITION DEVICE AND CONSTRUCTION MACHINE PROVIDED WITH SAME

(71) Applicants: HIROSHIMA UNIVERSITY, Higashi-Hiroshima (JP); KOBELCO CONSTRUCTION MACHINERY CO., LTD., Hiroshima (JP)

(72) Inventors: Ryota Hashimoto, Hiroshima (JP); Yasuhiko Shimazu, Hiroshima (JP); Takunori Yamaguchi, Hiroshima (JP); Sho Okimoto, Hiroshima (JP)

(73) Assignees: HIROSHIMA UNIVERSITY, Higashi-Hiroshima (JP); KOBELCO CONSTRUCTION MACHINERY CO., LTD., Hiroshima (JP)

( * ) Notice: Subject to any disclaimer, the term of this patent is extended or adjusted under 35 U.S.C. 154(b) by 113 days.

(21) Appl. No.: 18/697,836

(22) PCT Filed: Sep. 21, 2022

(86) PCT No.: PCT/JP2022/035174
§ 371 (c)(1),
(2) Date: Apr. 2, 2024

(87) PCT Pub. No.: WO2023/063038
PCT Pub. Date: Apr. 20, 2023

(65) Prior Publication Data

US 2025/0003200 A1 Jan. 2, 2025

(30) Foreign Application Priority Data

Oct. 11, 2021 (JP) ..... 2021-166835

(51) Int. Cl.
*E02F 9/26* (2006.01)

(52) U.S. Cl.
CPC ..... *E02F 9/264* (2013.01)

(58) Field of Classification Search
CPC ..... E02F 9/264
See application file for complete search history.

(56) References Cited

U.S. PATENT DOCUMENTS

2004/0158355 A1 8/2004 Holmqvist et al.
2016/0251821 A1 9/2016 Yoshida et al.
(Continued)

FOREIGN PATENT DOCUMENTS

CN 111411657 A * 7/2020 ..... E02F 3/40
JP 2008-241300 A 10/2008
(Continued)

OTHER PUBLICATIONS

International Search Report mailed on Dec. 6, 2022 in PCT/JP2022/035174 filed on Sep. 21, 2022 (3 pages).
(Continued)

*Primary Examiner* — Aryan E Weisenfeld
*Assistant Examiner* — Jeffrey R Chalhoub
(74) *Attorney, Agent, or Firm* — Oblon, McClelland, Maier & Neustadt, L.L.P.

(57) ABSTRACT

A bucket information acquisition device for acquiring information regarding the shape of a bucket that rotates about a rotational center axis along a predetermined moving plane in a construction machine includes: a distance distribution acquisition unit that acquires the three-dimensional distance distribution of the bucket with respect to a reference point; a reference cross section extraction unit that extracts, from the distance distribution acquired by the distance distribution acquisition unit, a reference cross section which is a cross section of the bucket obtained by cutting the bucket along a plane parallel to the moving plane; an approximate line identification unit that identifies, based on the reference
(Continued)

cross section, an approximate line approximating the reference cross section composed of a straight line and a curve; and a bucket shape calculation unit that calculates bucket shape information regarding the shape of the bucket based on the approximate line.

15 Claims, 12 Drawing Sheets

(56) References Cited

U.S. PATENT DOCUMENTS

| | | | | |
|---|---|---|---|---|
| 2018/0120098 | A1* | 5/2018 | Matsuo | G01F 17/00 |
| 2018/0239849 | A1 | 8/2018 | Martinsson et al. | |
| 2021/0017733 | A1 | 1/2021 | Kumakura et al. | |
| 2022/0002979 | A1 | 1/2022 | Sano | |
| 2022/0412056 | A1* | 12/2022 | Hoso | G01G 19/086 |

FOREIGN PATENT DOCUMENTS

| | | | |
|---|---|---|---|
| JP | 2019-39207 | A | 3/2019 |
| JP | 2019-190171 | A | 10/2019 |
| JP | 2021-57694 | A | 4/2021 |
| JP | 2021-85178 | A | 6/2021 |
| KR | 10-2034281 | B1 | 10/2019 |
| WO | WO 2014/171024 | A1 | 10/2014 |
| WO | WO 2016/170665 | A1 | 10/2016 |
| WO | WO 2020/196838 | A1 | 10/2020 |

OTHER PUBLICATIONS

Office Action issued in Japanese Patent Application No. 2021-166835 on Mar. 21, 2026, with English translation, citing document 1 therein.

* cited by examiner

BUCKET INFORMATION ACQUISITION DEVICE AND CONSTRUCTION MACHINE PROVIDED WITH SAME

TECHNICAL FIELD

The present invention relates to a bucket information acquisition device capable of acquiring information regarding the shape of a bucket, and a construction machine including the bucket information acquisition device.

BACKGROUND ART

Conventionally, a hydraulic excavator (construction machine) including a bucket for excavating the ground of a work site has been known. The hydraulic excavator includes a lower travelling body capable of travelling on the ground, an upper body mounted on the lower travelling body, and a work attachment supported by the upper body. A bucket is mounted on a tip portion of the work attachment.

Patent Literature 1 discloses a technique for measuring a work amount of a construction machine having a bucket. In the technique, a construction machine includes a plurality of cameras and an image processing unit. A plurality of cameras shoot a bucket in a state of holding earth and sand by excavation work and a bucket after earth and sand are discharged, and acquires three-dimensional data of each of them. An image processing unit acquires information (bucket shape information) regarding the shape of a bucket including earth and sand based on each piece of three-dimensional data, and calculates a work amount (earth and sand carrying amount) of a bucket from a difference between bucket form information at the time of excavation and bucket form information after earth and sand are discharged.

CITATION LIST

Patent Literature

Patent Literature 1: JP 2008-241300 A

In the technique described in Patent Literature 1, since the image processing unit calculates each piece of bucket shape information from three-dimensional data shot by a camera, there is a problem that a data amount handled by the image processing unit at the time of calculation is large, and a load of calculation processing is also large.

SUMMARY OF INVENTION

An object of the present invention is to provide a bucket information acquisition device capable of acquiring bucket shape information while reducing a data amount to be handled and a processing load as compared with a case where bucket shape information is directly calculated from three-dimensional data, and a construction machine including the bucket information acquisition device.

Provided by the present invention is a bucket information acquisition device for acquiring information regarding the shape of a bucket in a construction machine. The bucket rotates about a rotational center axis along a predetermined moving plane. The bucket information acquisition device includes a distance distribution acquisition unit, a reference cross section extraction unit, an approximate line identification unit, and a bucket shape calculation unit. The distance distribution acquisition unit acquires three-dimensional distance distribution of the bucket with respect to a reference point. The reference cross section extraction unit extracts a reference cross section, which is a cross section of the bucket obtained by cutting the bucket along a plane parallel to the moving plane, from the distance distribution acquired by the distance distribution acquisition unit. The approximate line identification unit identifies an approximate line including a straight line and a curve and approximate to the reference cross section based on the reference cross section. The bucket shape calculation unit calculates bucket shape information, which is information regarding the shape of the bucket, based on the approximate line.

Also provided by the present invention is a construction machine. The construction machine includes a machine body, a derricking body that has a tip portion and is supported by the machine body in a derrickable manner, a bucket rotatably supported by the tip portion of the derricking body about a rotational center axis extending in a left-right direction, and the bucket information acquisition device described above capable of acquiring bucket shape information that is information regarding a shape of the bucket.

DESCRIPTION OF EMBODIMENTS

Figure 1:
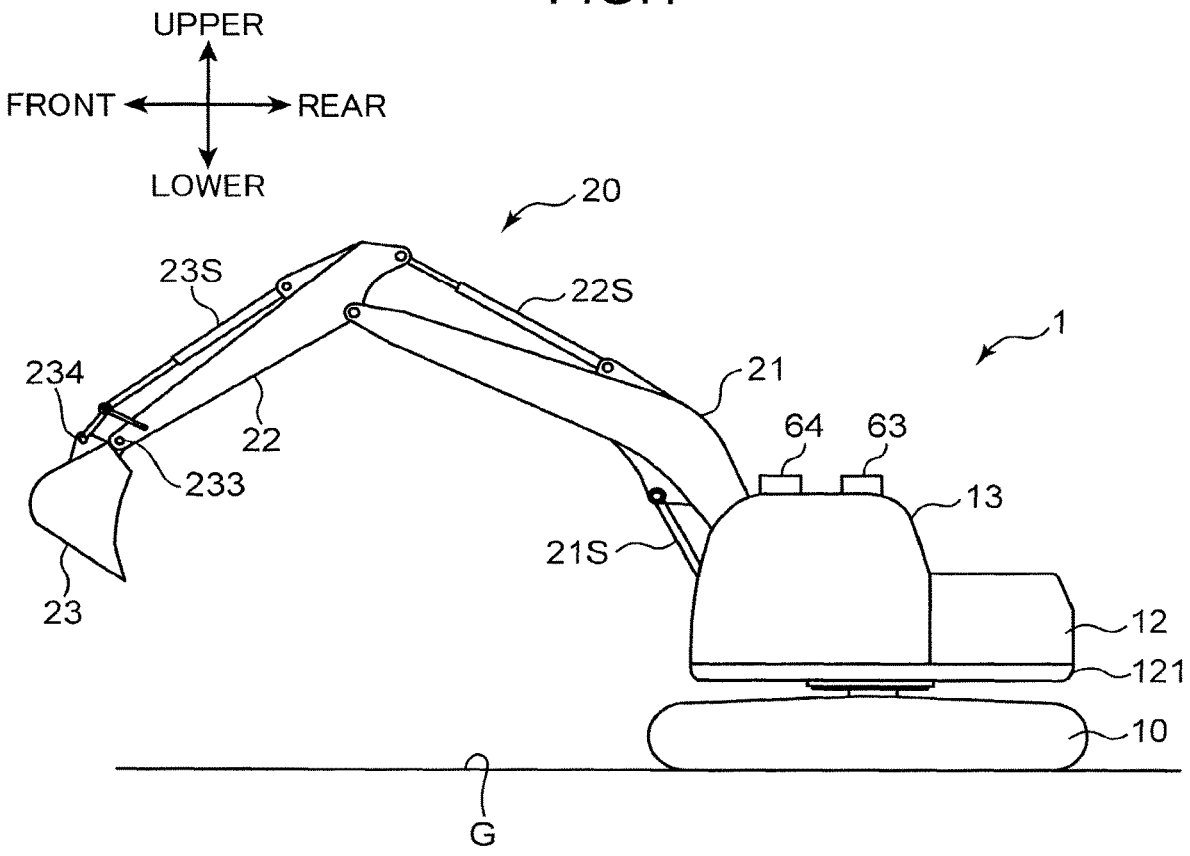
FIG. 1 is a side view of a construction machine including a bucket information acquisition device according to an embodiment of the present invention.

Hereinafter, a preferred embodiment of the present invention will be described with reference to the drawings. FIG. 1 is a side view of a hydraulic excavator 1 (construction machine) according to an embodiment of the present invention.

The hydraulic excavator 1 includes a lower travelling body 10 capable of travelling on the ground G (travelling surface), an upper slewing body 12 slewably supported by the lower travelling body 10, and a work attachment 20 mounted on the upper slewing body 12. The lower travelling body 10 and the upper slewing body 12 constitute a machine body of the present invention.

The lower travelling body 10 can travel on the ground G. The lower travelling body 10 includes a crawler type travelling unit.

The upper slewing body 12 includes a slewing frame 121 supported by the lower travelling body 10 and a cab 13 mounted on the slewing frame 121. The cab 13 allows a worker to get in, and various devices for operating the hydraulic excavator 1 are arranged in the cab 13.

The work attachment 20 is mounted on the upper slewing body 12 so as to be movable relative to the upper slewing body 12, and performs predetermined work on the ground. The work attachment 20 includes a boom 21 connected to a front end portion of the slewing frame 121 so as to be rotatable in a derricking direction about a horizontal rotational center axis, an arm 22 connected to a tip portion of the boom 21 so as to be rotatable about a horizontal rotational center axis, and a bucket 23 connected to a tip portion of the arm 22 (tip portion of a derricking body) so as to be rotatable about a horizontal rotational center axis (rotational axis extending in a left-right direction). The rotational center axes of the boom 21, the arm 22, and the bucket 23 are set to be parallel to each other. The boom 21 and the arm 22 constitute a derricking body of the present invention. Further, the work attachment 20 further includes a boom cylinder 21S (derricking body cylinder) that expands and contracts so as to derrick (rotate) the boom 21, an arm cylinder 22S (derricking body cylinder) that expands and contracts so as to rotate the arm 22, and a bucket cylinder 23S that expands and contracts so as to rotate the bucket 23. Each of these cylinders includes a hydraulic cylinder.

The cab 13 is mounted on a front portion of the slewing frame 121, which is a portion (a left side of the boom 21 in the example illustrated in FIG. 1) adjacent to the boom 21 in a width direction of the slewing frame 121, and constitutes an operator's cab for operating the hydraulic excavator 1. That is, in the cab 13, a worker performs operation for travelling the lower travelling body 10, slewing the upper slewing body 12, and activating the work attachment 20.

Figure 2:
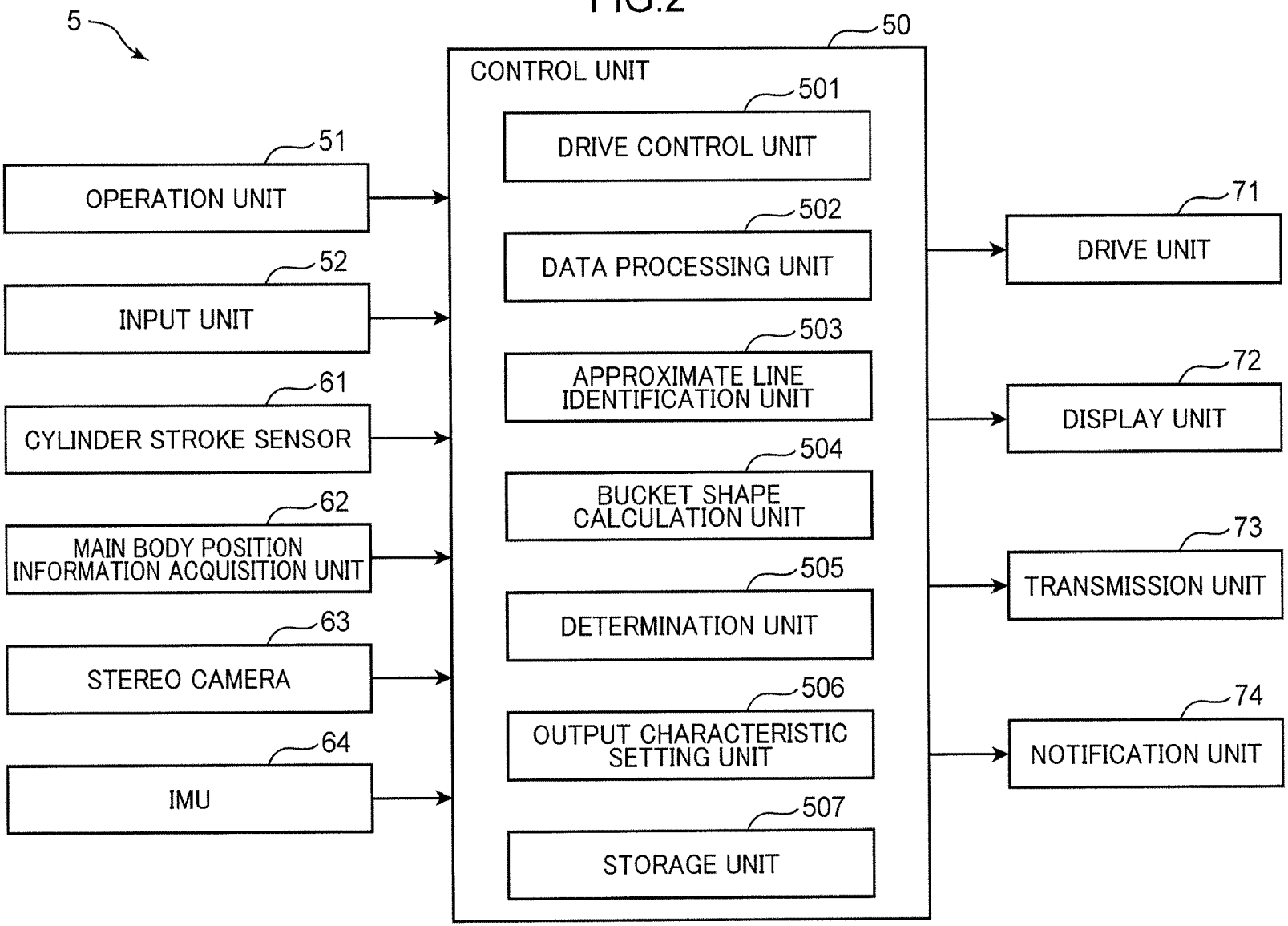
FIG. 2 is a block diagram of the construction machine including the bucket information acquisition device according to the embodiment of the present invention.

The hydraulic excavator 1 further includes a bucket information acquisition device 5. The bucket information acquisition device 5 acquires information regarding a shape of the bucket 23 (bucket shape information). FIG. 2 is a block diagram of the hydraulic excavator 1 including the hydraulic excavator 1 according to the present embodiment. The hydraulic excavator 1 further includes an operation unit 51, an input unit 52, a cylinder stroke sensor 61, a main body position information acquisition unit 62 (position information acquisition unit), a stereo camera 63 (distance distribution acquisition unit), an inertial measurement unit (IMU) 64, a drive unit 71, a display unit 72, a transmission unit 73, and a notification unit 74.

The operation unit 51 is arranged in the cab 13 and is operated by a worker. That is, the operation unit 51 receives operation for operating the hydraulic excavator 1. The operation includes travelling of the lower travelling body 10, slewing the upper slewing body 12, driving the work attachment 20 (the boom 21, the arm 22, and the bucket 23), and the like.

The input unit 52 is arranged in the cab 13 and receives input of various types of information. As an example, the input unit 52 includes various input buttons, a switch, a touch panel included in the display unit 72 to be described later, and the like. In particular, the input unit 52 can receive input of information to be referred to in bucket information acquisition processing.

The cylinder stroke sensor 61 includes three sensors mounted on the boom cylinder 21S, the arm cylinder 22S, and the bucket cylinder 23S described above, and detects a stroke (elongation amount and length) of each of the cylinders. A stroke of each cylinder detected by the cylinder stroke sensor 61 is used to calculate a position and posture of the bucket 23. Note that, in order to calculate a position and posture of the bucket 23, an angle sensor that detects a rotation angle of the boom 21, the arm 22, and the bucket 23 may be used instead of the cylinder stroke sensor 61.

The main body position information acquisition unit 62 acquires position information of the hydraulic excavator 1 (machine body) at a work site. As an example, the main body position information acquisition unit 62 can acquire main body coordinate information that is information regarding absolute coordinates at a work site of a main body reference point provided in the upper slewing body 12 in advance. The main body position information acquisition unit 62 constituting a main body reference point is arranged on an upper surface portion of the cab 13 and functions as a GNSS mobile station. On the other hand, a global navigation satellite system (GNSS) reference station is provided to acquire the main body coordinate information (not illustrated). The GNSS reference station is a reference station arranged at a work site or arranged at a position closest to a work site. Note that, as a GNSS, in addition to a publicly known global positioning system (GPS), a satellite positioning system such as a global navigation satellite system (GLONASS), Galileo, or a quasi-zenith satellite system (QZSS) may be employed.

The stereo camera 63 (distance distribution acquisition unit) is arranged at a front end of an upper surface portion of the cab 13. The stereo camera 63 shoots a surrounding object in front of the cab 13. Specifically, the stereo camera 63 has a reference point (coordinate origin), and can acquire three-dimensional distance distribution of a surrounding object including the bucket 23 with respect to the reference point. The three-dimensional distance distribution is distribution of distances between the reference point and a plurality of surrounding measurement points. Acquired distance distribution is input to a control unit 50 as three-dimensional distance data. In the present embodiment, a shape of the bucket 23 is estimated based on three-dimensional distance data detected by the stereo camera 63. At this time, a shape, a position, and the like of the bucket 23 are set with reference to the reference point. Note that the reference point may be another specific portion of the hydraulic excavator 1. Further, in another embodiment, the distance distribution acquisition unit may include a time of flight (TOF) sensor or a light detection and ranging (LiDAR) sensor.

The IMU 64 detects an angle of a machine body (the upper slewing body 12) of the hydraulic excavator 1 with respect to a horizontal plane.

The drive unit 71 drives various structures of the hydraulic excavator 1, and drives the lower travelling body 10, the upper slewing body 12, the work attachment 20, and the like operated by the operation unit 51. In particular, the drive unit 71 can drive the work attachment 20 such that the bucket 23 excavates the ground. At this time, the drive unit 71 can receive a predetermined command signal and drive the work attachment 20 based on an output characteristic according to the command signal. The output characteristic is set in stages such as weak, medium, and strong. The drive unit 71 includes a hydraulic circuit such as a hydraulic pump and a hydraulic motor.

The display unit 72 is arranged in the cab 13, receives a predetermined display command signal, and displays various types of information to be notified to a worker in accordance with the display command signal. The information includes bucket shape information to be described later, position information of the hydraulic excavator 1, and the like. Further, the display unit 72 can display map information at a work site, and can display acquired bucket shape information and position information of the hydraulic excavator 1 acquired by the main body position information acquisition unit 62 on the map in association with each other.

The transmission unit 73 transmits position information of the hydraulic excavator 1 acquired by the main body position information acquisition unit 62 and shape information of the bucket 23 acquired by the bucket information acquisition device 5 to a data center, a remote management center (refer to a server 90 to be described later, an example of a management device), or the like arranged at a place distant from a work site.

The notification unit 74 notifies a worker of predetermined notification information. As an example, the notification unit 74 includes a warning lamp, a warning buzzer, and the like provided in the cab 13.

The control unit 50 includes a central processing unit (CPU), a read only memory (ROM) that stores a control program, random access memory (RAM) used as a work area for the CPU, and the like. As illustrated in FIG. 2, the operation unit 51, the input unit 52, the cylinder stroke sensor 61, the main body position information acquisition unit 62, the stereo camera 63, the IMU 64, the drive unit 71, the display unit 72, the transmission unit 73, and the notification unit 74 are connected to the control unit 50.

The CPU executes a control program stored in a ROM, so that the control unit 50 functions to include a drive control unit 501, a data processing unit 502 (reference cross section extraction unit), an approximate line identification unit 503, a bucket shape calculation unit 504, a determination unit 505, an output characteristic setting unit 506, and a storage unit 507. The control unit 50 of the hydraulic excavator 1 constitutes a part of the bucket information acquisition device 5.

The drive control unit 501 inputs a drive command signal to the drive unit 71 in accordance with content of operation received by the operation unit 51. As a result, operation of the lower travelling body 10, the upper slewing body 12, the work attachment 20, and the like is controlled.

The data processing unit 502 performs predetermined processing on three-dimensional distance data (distance distribution) acquired by the stereo camera 63. In particular, the data processing unit 502 extracts a reference cross section J (FIG. 5), which is a cross section of the bucket 23 obtained by cutting the bucket 23 along a plane intersecting the left-right direction (left-right direction of the upper slewing body 12), from distance distribution acquired by the stereo camera 63.

The approximate line identification unit 503 identifies an approximate line K (FIG. 5) including a straight line and a curve and approximating the reference cross section J based on the reference cross section J.

The bucket shape calculation unit 504 calculates bucket shape information that is information regarding a shape of the bucket 23. In particular, the bucket shape calculation unit 504 calculates bucket shape information based on the approximate line K identified by the approximate line identification unit 503. The bucket shape information includes a dimension and a shape of the approximate line K, an accommodation cross sectional area to be described later, a position of a centroid, a width dimension of the bucket 23, bucket capacity V, a position of a bucket fulcrum portion 233 (rotational axis), and the like.

The determination unit 505 executes various types of determination processing executed in the bucket information acquisition processing to be described later.

The output characteristic setting unit 506 sets (adjusts) an output characteristic of the drive unit 71 based on bucket shape information calculated by the bucket shape calculation unit 504, and inputs a command signal corresponding to the characteristic to the drive unit 71.

The storage unit 507 stores in advance various thresholds, parameters, and the like referred to in activation of the hydraulic excavator 1 and the bucket information acquisition processing.

Figure 3:
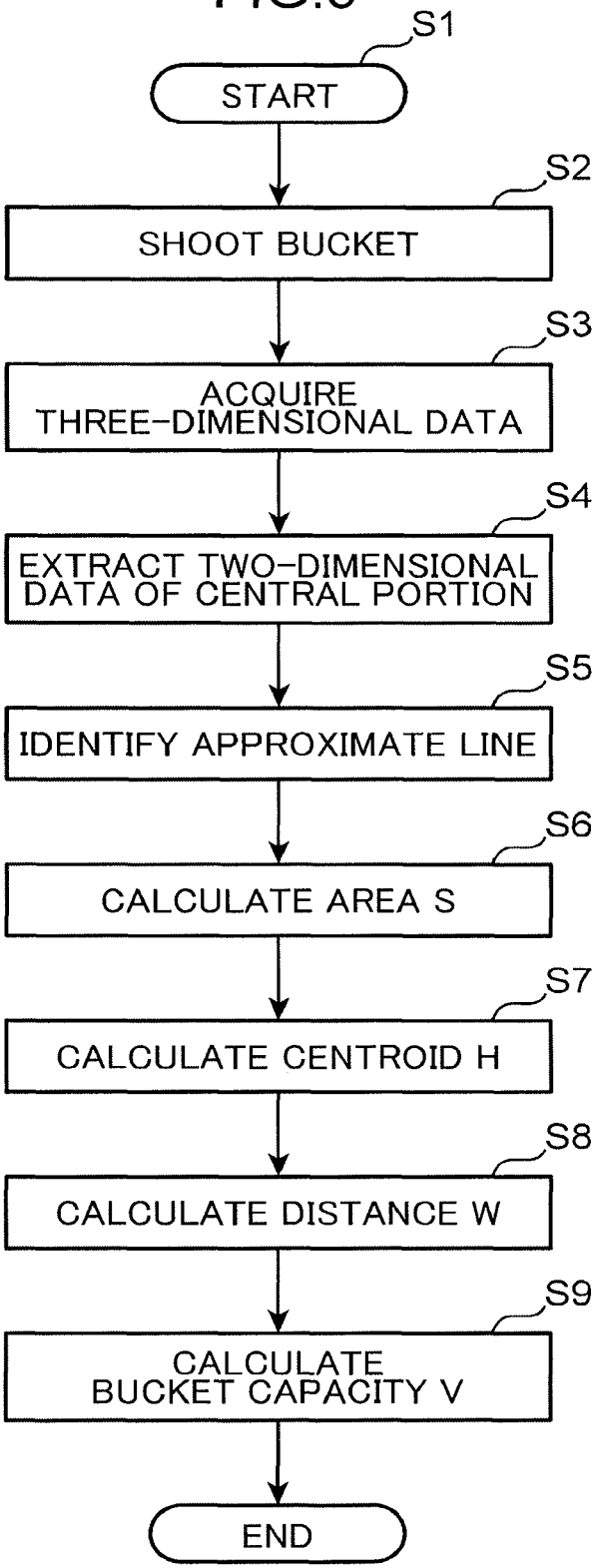
FIG. 3 is a flowchart of bucket information acquisition processing executed by the bucket information acquisition device according to the embodiment of the present invention.
Figure 4:
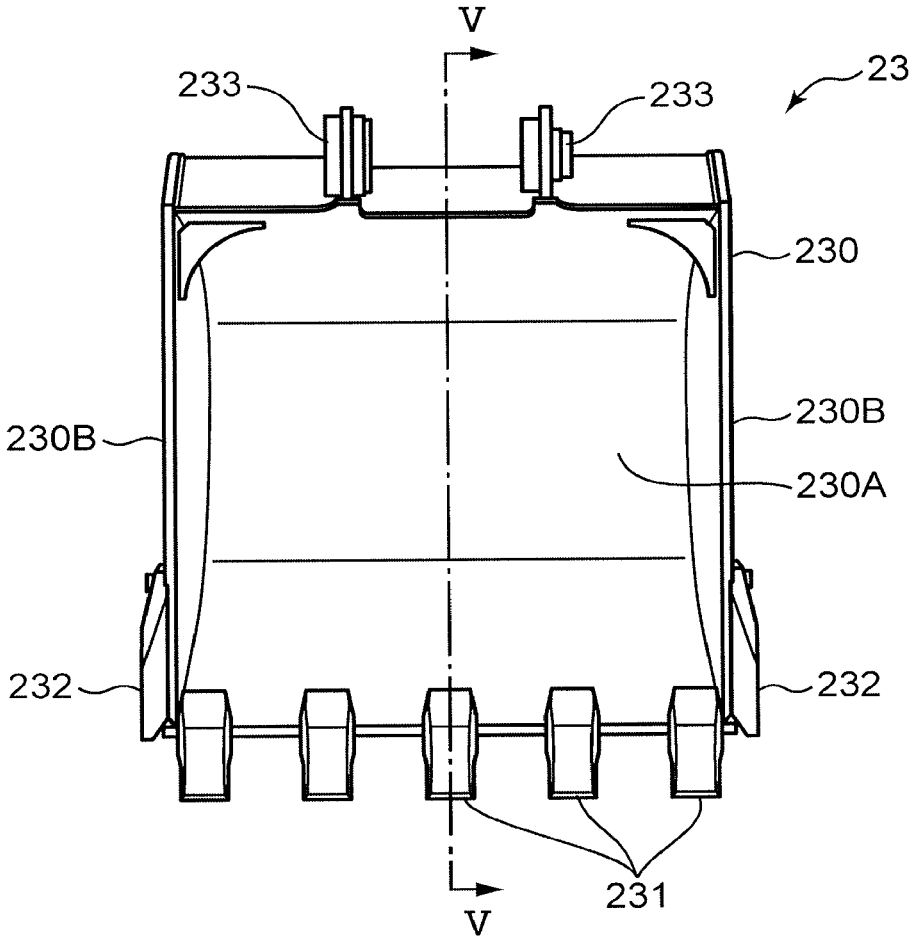
FIG. 4 is a diagram of a bucket viewed from a machine body side of the construction machine.
Figure 5:
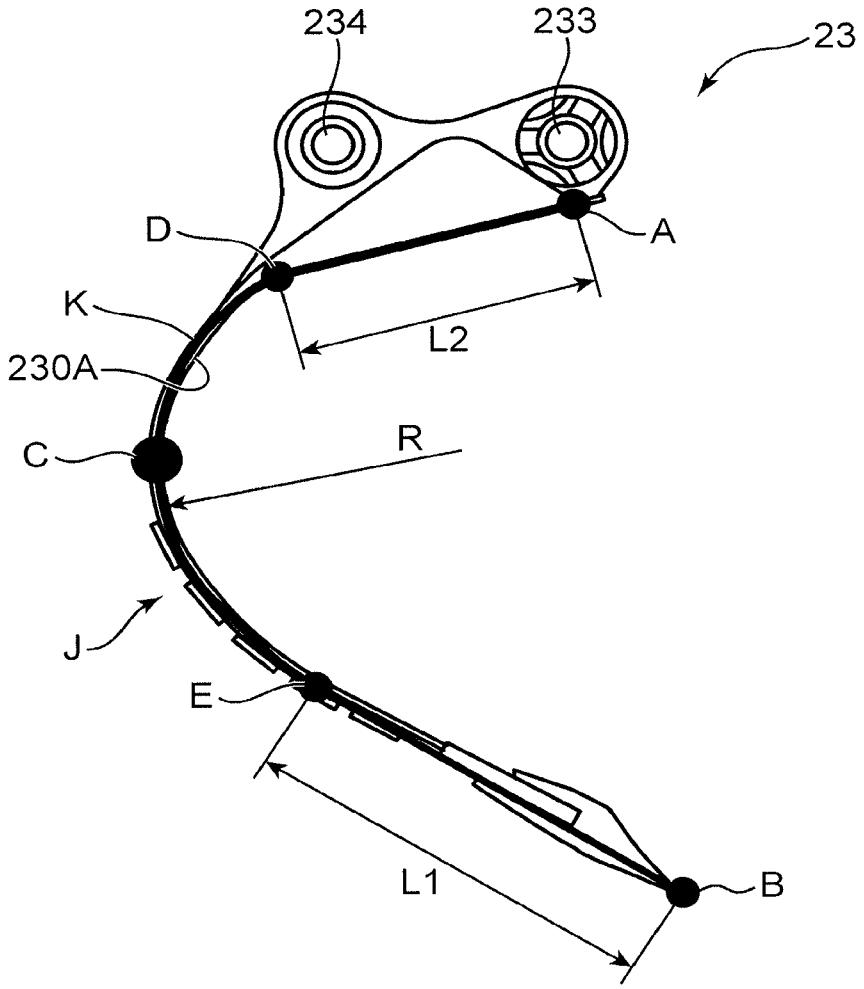
FIG. 5 is a diagram illustrating a reference cross section and an approximate line of the bucket.
Figure 6:
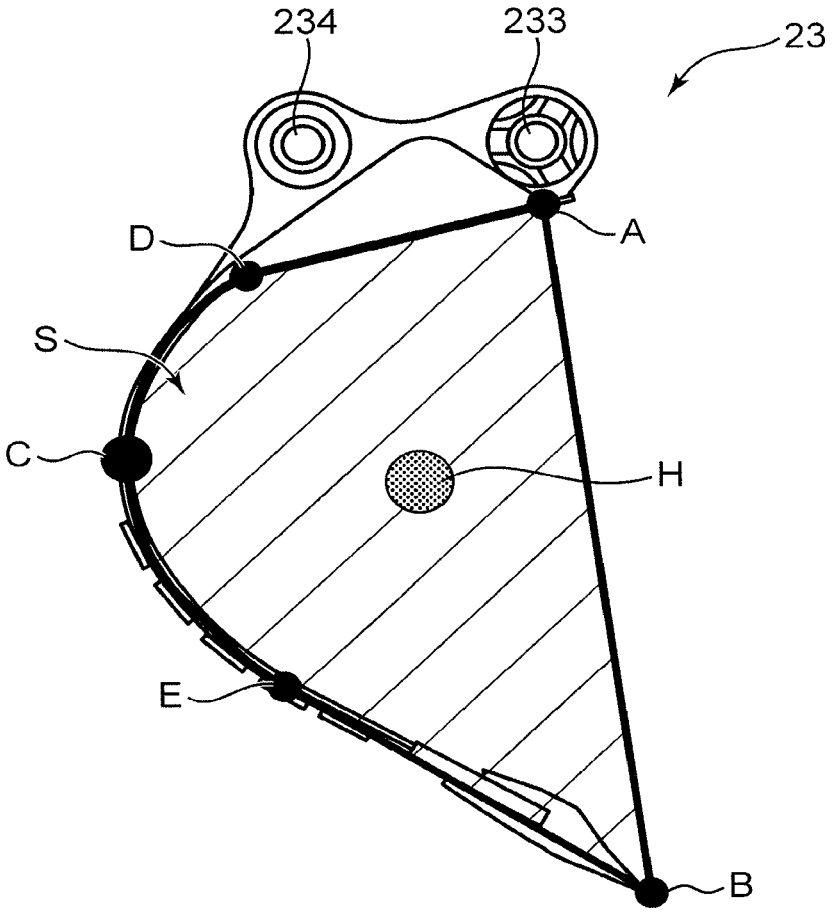
FIG. 6 is a diagram illustrating a reference cross section, an approximate line, and a centroid of the bucket.

FIG. 3 is a flowchart of the bucket information acquisition processing executed by the bucket information acquisition device 5 according to the present embodiment. FIG. 4 is a diagram of the bucket 23 viewed from the machine body side of the hydraulic excavator 1. FIG. 5 is a diagram illustrating the reference cross section J and the approximate line K of the bucket 23. FIG. 6 is a diagram illustrating the reference cross section J, the approximate line K, and the centroid H of the bucket 23.

The bucket information acquisition processing executed by the bucket information acquisition device 5 will be described with reference to FIG. 3. A worker can input a command for starting the bucket information acquisition processing through the input unit 52 provided in the cab 13. The command may be issued when a new one of the bucket 23 is attached to a tip portion of the arm 22 or at a timing when a day's work starts. Note that the bucket 23 rotates about the rotational center axis along a predetermined moving plane. In a case where the hydraulic excavator 1 is arranged horizontally, the rotational center axis extends in parallel with the left-right direction of the upper slewing body 12.

When the bucket information acquisition processing is started (step S1), the stereo camera 63 shoots the bucket 23 in front of the cab 13. As a result, distance distribution (three-dimensional data) of a surrounding object including the bucket 23 with respect to a predetermined reference point is acquired (step S2). Note that the reference point (origin) is set, for example, on an upper surface portion of the cab 13 in which the stereo camera 63 is arranged.

Three-dimensional data acquired by the stereo camera 63 is input to the control unit 50 (step S3), and is subjected to predetermined processing by the data processing unit 502. Since an imaging range of the stereo camera 63 includes the ground other than the bucket 23, the data processing unit 502 extracts distance distribution of the bucket 23 from distance distribution (three-dimensional distance data) acquired by the stereo camera 63 according to a distance from the reference point. Furthermore, the data processing unit 502 extracts the reference cross section J (FIG. 5) which is a cross section of the bucket 23 obtained by cutting the bucket 23 along a plane (a plane orthogonal to (intersecting) the left-right direction of the upper slewing body 12) parallel to the moving plane from the extracted distance distribution. In the present embodiment, the data processing unit 502 extracts cross sectional data (two-dimensional data) in a central portion in the left-right direction of the bucket 23 (step S4). The cross sectional data includes a lot of distance distribution data in a thickness direction of the bucket 23 and a length direction of the bucket 23. Note that, in order for extraction of the reference cross section J, an attachment position of the stereo camera 63 and a left-right direction width of a central cross section of the work attachment 20 are stored in advance in the storage unit 507. Then, the reference cross section J is desirably set to a plane parallel to a central cross section of the work attachment 20 or a plane orthogonal to a rotation axis of the bucket 23.

An example of a shape of the bucket 23 will be described with reference to FIG. 4. The bucket 23 includes a bucket body 230, a plurality of claw portions 231, a pair of left and right lateral claw portions 232, a pair of left and right bucket fulcrum portions 233, and a pair of left and right bucket link fulcrum portions 234 (FIG. 1).

The bucket body 230 is a main body portion of the bucket 23 and has a shape that accommodates excavated earth and sand. The bucket body 230 includes a bottom portion 230A and a pair of left and right wall portions 230B. The bottom portion 230A has a substantially U-shape in a cross sectional view. A pair of the left and right wall portions 230B are connected to left and right end portions of the bottom portion 230A, respectively. Each of a plurality of the claw portions 231 is attached to a tip portion of the bottom portion 230A, and has a function of excavating the ground. A pair of the left and right lateral claw portions 232 are fixed to an end portion of the wall portion 230B, and promotes entry of earth and sand into the bucket body 230.

A pair of the left and right bucket fulcrum portions 233 are fixed to a base end portion (upper end portion) of the bucket body 230. The bucket fulcrum portion 233 is rotatably mounted on a tip portion of the arm 22 by a coupling pin (not illustrated). That is, a pair of the left and right bucket fulcrum portions 233 constitute a rotational center axis of the bucket 23. A pair of the left and right bucket link fulcrum portions 234 are fixed to the bucket body 230 behind a pair of the left and right bucket fulcrum portions 233. A pair of the left and right bucket link fulcrum portions 234 are rotatably connected to a link member connected to a cylinder rod of the bucket cylinder 23S (FIG. 1).

In step S4 of FIG. 3, when the data processing unit 502 extracts two-dimensional data, cross sectional data (the reference cross section J) of FIG. 5 cut at a cross section position V-V of FIG. 4 is acquired. Note that a cut surface for acquiring two-dimensional data for three-dimensional data may be set to extend in a vertical direction according to a detection result of the IMU 64, or may be a plane orthogonal to a virtual horizontal axis set in advance in a coordinate system of the stereo camera 63. Further, a central portion in the left-right direction of the bucket 23 may be determined from three-dimensional data, or its position may be stored in the storage unit 507 in advance and referred to by the data processing unit 502.

Next, the approximate line identification unit 503 identifies the approximate line K corresponding to the reference cross section J of the bucket 23 (step S5 in FIG. 3). In the present embodiment, the approximate line identification unit 503 identifies the approximate line K such that the approximate line K includes a pair of straight line segments (bottom plate upper straight line portion AD and bottom plate lower straight line portion BE) and at least one curve (curve portion DCE) connecting the pair of line segments (FIG. 5).

Specifically, the approximate line identification unit 503 fixes an end point (point A) of the bottom plate upper straight line portion AD to a base end (plate end) of the reference cross section J. Next, the approximate line identification unit 503 fixes an end portion (point B) of the bottom plate lower straight line portion BE to a tip (claw tip) of the reference cross section J. Next, the approximate line identification unit 503 extends a straight line from the point A along the reference cross section J, and sets a position at which the reference cross section J is separated from the straight line as a point D. Similarly, the approximate line identification unit 503 extends a straight line from the point B along the reference cross section J, and sets a position at which the reference cross section J is separated from the straight line as a point E. As a result, the approximate line identification unit 503 identifies the bottom plate upper straight line portion AD and the bottom plate lower straight line portion BE. At this time, the bucket shape calculation unit 504 calculates a length (L2, L1) of each straight line portion as bucket shape information.

Next, the approximate line identification unit 503 assumes that the curve portion DCE is an are in contact with the bottom plate upper straight line portion AD and the bottom plate lower straight line portion BE at the point D and the point E, respectively, and the bucket shape calculation unit 504 calculates a curvature radius R of the curve portion DCE. As a result, the approximate line identification unit 503 identifies a shape of the curve portion DCE. Note that, in another embodiment, the approximate line identification unit 503 may extract an optional point C on the reference cross section J between the point D and the point E and identify an arc passing through the point D, the point C, and the point E as the curve portion DCE. At this time, the approximate line identification unit 503 desirably extracts a point at a deepest position (having a large depth) with respect to the points A and B as the point C. As described above, the approximate line identification unit 503 can identify the approximate line K that approximates the reference cross section J of the bucket 23. Note that the identified approximate line K may be displayed on the display unit 72 so that its shape is notified to a worker. At this time, the approximate line K and the reference cross section J are preferably superimposed and displayed on the display unit 72.

Next, the bucket shape calculation unit 504 calculates an accommodation cross sectional area S (FIG. 6), which is an area of a region surrounded by a line segment AB connecting a tip (point B) of the approximate line K and a base end (point A) on the opposite side of the tip and the approximate line K, as shape information of a bucket (step S6 in FIG. 3). A publicly known image processing method can be used to calculate the area S. As an example, a region surrounded by the point A, the point B, the point C, the point D, and the point E in FIG. 6 may be binarized, and the number of pixels of the region may be measured. Further, the area S may be calculated by integrating distances from the line segment AB to the line segment AD, the curve DCE, and the line segment BE with the line segment AB as a reference.

Next, the bucket shape calculation unit 504 calculates a position of the centroid H in FIG. 6 (step S7 in FIG. 3). That is, the bucket shape calculation unit 504 calculates a position of the centroid HI of a region surrounded by the line segment AB connecting a tip (point B) and a base end (point A) of the approximate line K and the approximate line K. Also for the calculation of the centroid H, a publicly known calculation method using a statical moment of area or the like can be used.

Next, the bucket shape calculation unit 504 calculates a distance W (step S8 in FIG. 3). The distance W corresponds to a width dimension which is a dimension of the bucket 23 in the left-right direction. Specifically, the bucket shape calculation unit 504 identifies relative positions of a pair of the left and right wall portions 230B (side walls) (FIG. 4) of the bucket 23 with respect to the reference point from distance distribution acquired by the stereo camera 63. Furthermore, the bucket shape calculation unit 504 calculates the distance W between a pair of left and right intersections where a straight line extending in the left-right direction through the centroid H (FIG. 6) intersects a pair of the left and right wall portions 230B, so as to calculate (estimate) a width dimension of the bucket 23. At this time, the left-right direction may be set in advance according to a reference point (origin) of the stereo camera 63, or may be set and corrected according to a detection result of the IMU 64.

Next, the bucket shape calculation unit 504 calculates bucket capacity V (accommodation volume) as bucket shape information (step S9 in FIG. 3). Specifically, the bucket shape calculation unit 504 calculates the bucket capacity V from the product of the calculated accommodation cross sectional area S and the estimated distance W (width dimension).

As described above, in the present embodiment, the bucket shape information including a dimension of the approximate line K indicating a cross sectional shape (the reference cross section J) of the bucket 23, the accommodation cross sectional area S, the width dimension W, and the bucket capacity V can be acquired based on distance distribution acquired by the stereo camera 63. In particular, the approximate line identification unit 503 identifies the approximate line K from cross sectional data (two-dimensional data) at a central portion (cross sectional position V-V in FIG. 4) of the bucket 23, so as to acquire the approximate line K that accurately approximates a cross sectional shape of the bucket 23. Since the approximate line K has a small information amount (data amount) as compared with three-dimensional data and two-dimensional data acquired by the stereo camera 63, calculation processing for the bucket shape information can be executed with a small processing load. Therefore, as compared with a case where the bucket shape information is directly calculated from three-dimensional data or the like, shape information of the bucket 23 can be acquired with high accuracy while a processing load of the control unit 50 (bucket shape calculation unit 504) in the hydraulic excavator 1 is reduced. Note that the acquired bucket shape information may be used for other control of the hydraulic excavator 1. Also in this case, since shape information of a bucket has a small amount of data capacity, a processing load at the time of control can be reduced.

Further, in the present embodiment, since shape information of the bucket 23 acquired by the approximate line identification unit 503 and the bucket shape calculation unit 504 is displayed on the display unit 72, a worker can easily understand a shape and a feature of the bucket 23. At this time, a 3D model for simple display on the display unit 72 may be created based on the bucket shape information. Note that, in the present embodiment, since the stereo camera 63 acquires distance distribution of the bucket 23, even in a case where the bucket 23 unknown to a worker is mounted on the hydraulic excavator 1, its shape information can be easily grasped.

Further, in the present embodiment, since the approximate line identification unit 503 identifies the approximate line K such that the approximate line K includes a pair of line segments and at least one curve connecting the pair of line segments, an information amount for identifying the approximate line K can be reduced as compared with a case where the approximate line K includes more line segments.

Furthermore, in the present embodiment, the bucket shape calculation unit 504 calculates the lengths L1 and L2 of the pair of line segments and the curvature radius R of the at least one arc as bucket shape information. Therefore, a shape of the bucket 23 can be identified based on simple information including a length and a radius. Note that the bucket shape information may include an angle of the arc described above.

Further, in the present embodiment, since the bucket shape calculation unit 504 can calculate an accommodation cross sectional area of the bucket 23 using the approximate line K, it is possible to easily grasp basic accommodation capacity of the bucket 23 while reducing a processing load of the bucket shape calculation unit 504.

Further, the bucket shape calculation unit 504 calculates a width dimension of the bucket 23 from distance distribution acquired by the stereo camera 63, and calculates accommodation volume of a bucket from an accommodation cross sectional area and a width dimension. For this reason, it is possible to accurately grasp earth and sand accommodation capacity of the bucket 23 while reducing a processing load of the bucket shape calculation unit 504.

At this time, since the bucket shape calculation unit 504 calculates a width dimension of the bucket 23 based on a distance between intersections of a straight line passing through a centroid and a pair of the left and right wall portions 230B, a processing load of the bucket shape calculation unit 504 can be further reduced as compared with a case where a width dimension is calculated directly using three-dimensional data.

Figure 7:
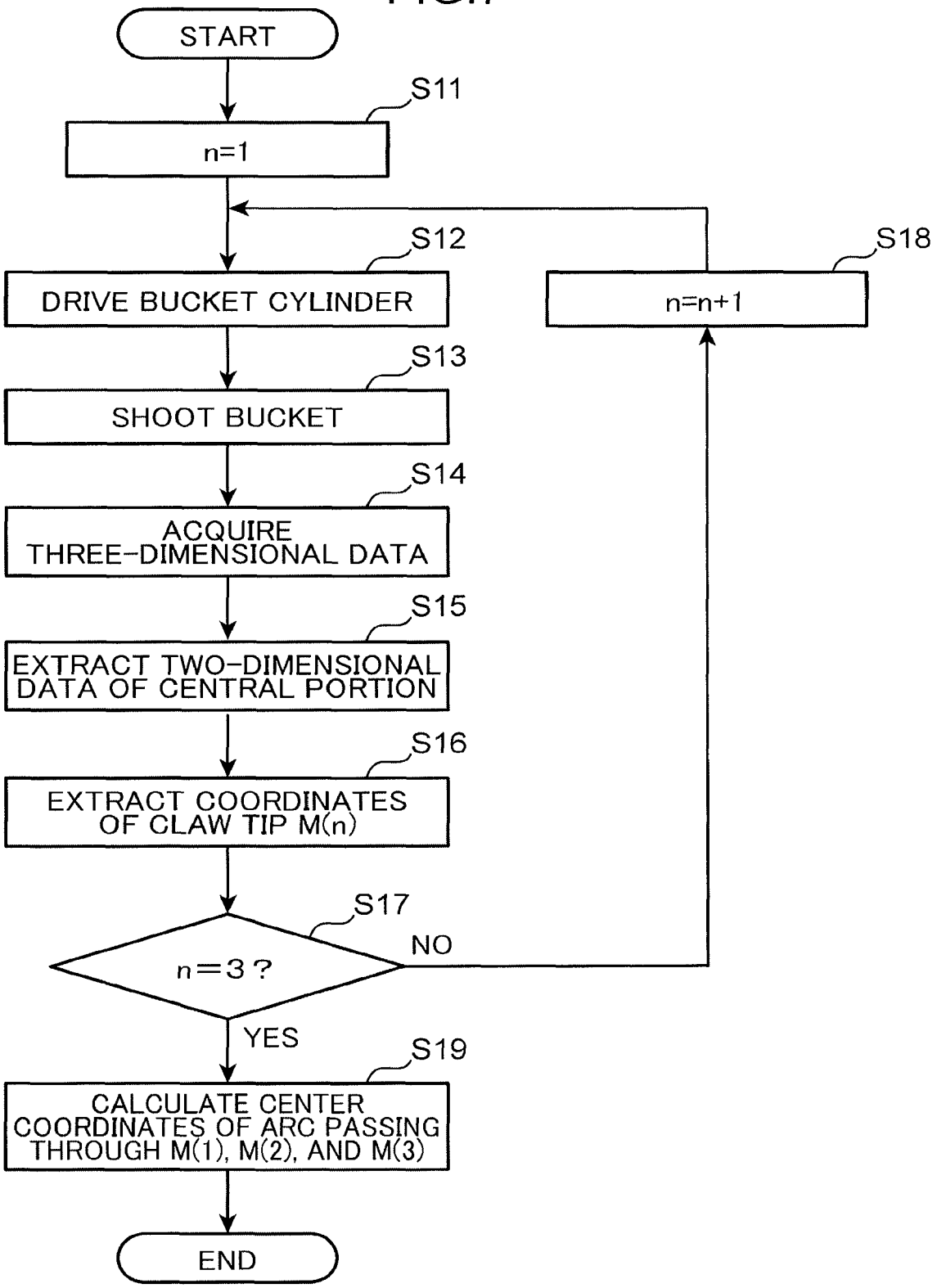
FIG. 7 is a flowchart of the bucket information acquisition processing executed by the bucket information acquisition device according to a variation of the present invention.
Figure 8:
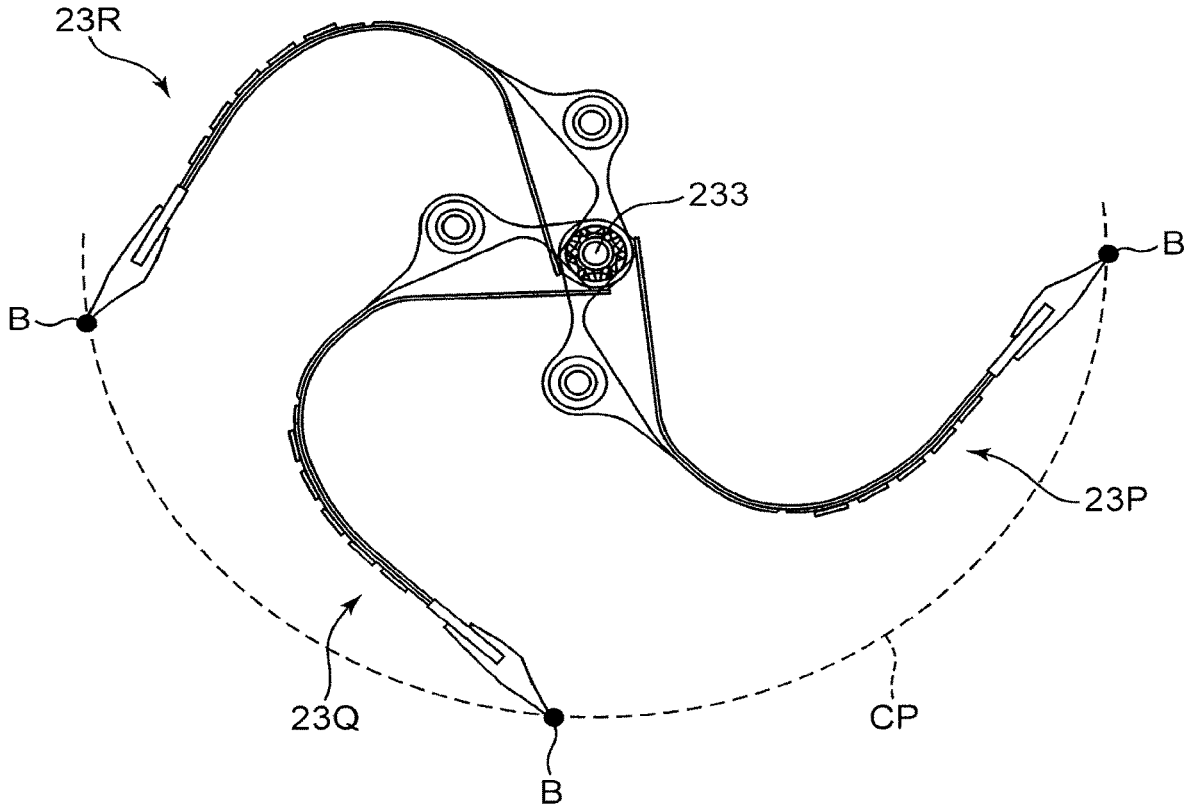
FIG. 8 is a diagram illustrating a state in which the bucket is sequentially set to three postures.

Next, each variation of the present invention will be described. FIG. 7 is a flowchart of the bucket information acquisition processing executed by the bucket information acquisition device according to a first variation of the present invention. FIG. 8 is a diagram illustrating a state in which a bucket is sequentially set to three postures. In the present variation, the bucket shape calculation unit 504 further calculates a relative position of the bucket fulcrum portion 233 (rotational center axis) with respect to a reference point of the stereo camera 63 as bucket shape information. Also in the present variation, bucket shape information similar to that in FIG. 3 is acquired.

When bucket information identification processing in the present variation is started, a repetition variable n is set to 1 (step S11), and the bucket cylinder 23S is driven by the drive unit 71. At this time, the drive control unit 501 (drive command input unit) inputs a drive command signal to the bucket drive unit such that the bucket 23 sequentially takes at least three different postures with respect to the ground according to the variable n (step S12). When the bucket 23 is set to a first posture (bucket 23P in FIG. 8), shooting of the bucket (step S13), acquisition of three-dimensional data (step S14), and extraction of two-dimensional data of a central portion (step S15) are executed in the same procedure as in the above embodiment. Further, the bucket shape calculation unit 504 extracts coordinates of a claw tip M(n) of the bucket 23 (step S16). As the coordinates of the claw tip M(n), coordinates of the point B of the approximate line K described above can be used. The acquired coordinates are stored in the storage unit 507.

Next, the determination unit 505 determines whether or not n is 3 (step S17). Here, when n<3 (NO in step S17), 1 is added to n in step S18, and steps S12 to S17 are repeated. Note that FIG. 8 illustrates a second posture (bucket 23Q) and a third posture (bucket 23R) of the bucket 23.

In a case where n=3 in step S17 (YES in step S17), the bucket shape calculation unit 504 calculates center coordinates of one arc CP passing through the three coordinates, M(1), M(2), and M(3), of a claw tip of the approximate lines K stored in the storage unit 507 as a relative position of the bucket fulcrum portion 233 with respect to a reference point (step S19).

As a result, the control unit 50 can grasp a position of the bucket fulcrum portion 233 with respect to a reference point of the stereo camera 63. Further, since the control unit 50 can grasp a movable range (arc CP) of a tip of the bucket 23 when the bucket 23 rotates, it is possible to accurately avoid collision of the bucket 23 with a surrounding object. Furthermore, since the bucket shape calculation unit 504 calculates a center position of one arc passing through tips (claw tips) of three of the approximate lines K as a relative position of the bucket fulcrum portion 233 with respect to a reference point, it is possible to grasp a position of the bucket fulcrum portion 233 (rotational center axis) with a small calculation load.

Note that the drive control unit 501 may input an emergency stop signal to the drive unit 71 to stop driving in a case where there is a possibility that a tip (claw tip) of the bucket 23 collides with a surrounding object based on a posture of a machine body of the hydraulic excavator 1 and a posture of the work attachment 20 including the bucket 23.

Note that, in the above description, the case where the bucket 23 is set to three postures is described, but an aspect in which the bucket 23 is set to two or more (a plurality of) postures may be employed. In a case where there are two postures, it is desirable to set two reference points corresponding to coordinates of the claw tip described above.

Figure 9:
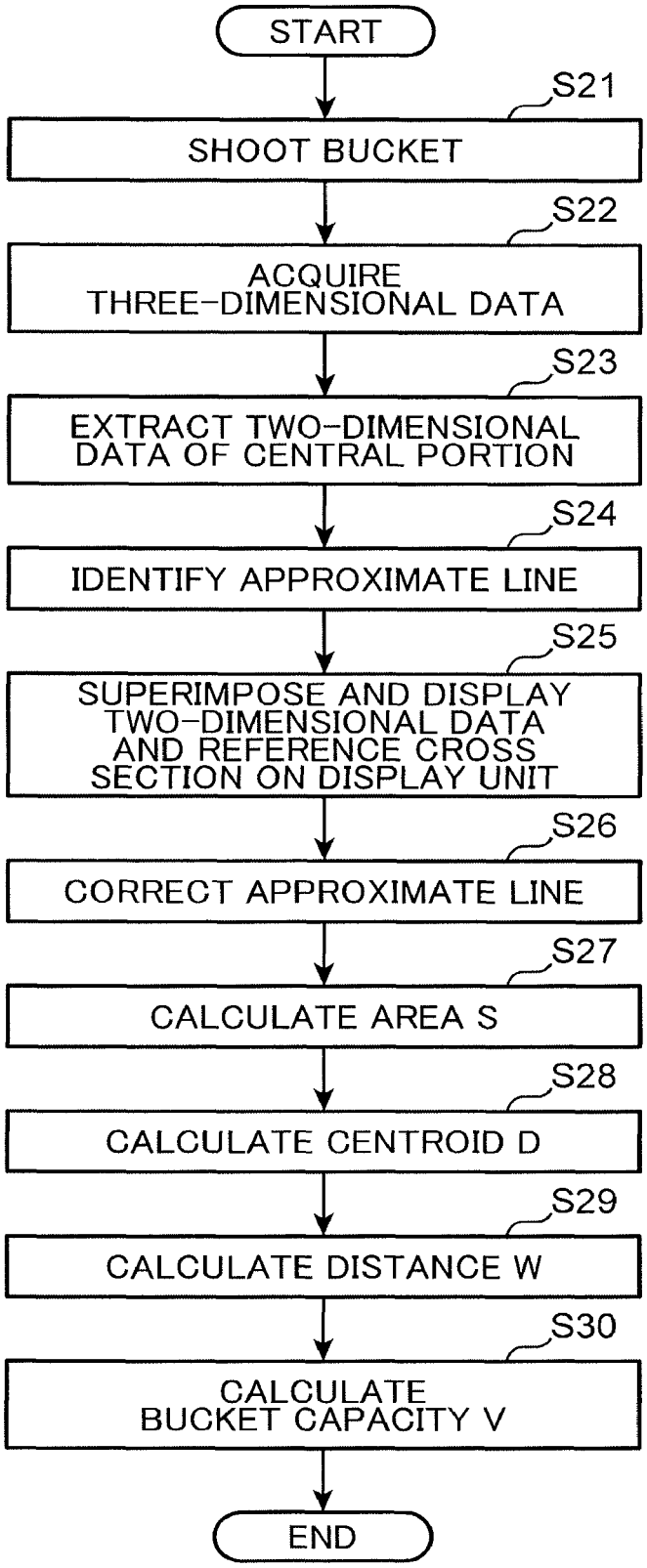
FIG. 9 is a flowchart of the bucket information acquisition processing executed by the bucket information acquisition device according to a variation of the present invention.

FIG. 9 is a flowchart of the bucket information acquisition processing executed by the bucket information acquisition device according to a second variation of the present invention. The present variation is characterized in that a worker can correct the approximate line K identified by the approximate line identification unit 503. In FIG. 9, steps S21 to S24 and steps S27 to S30 are the same as steps S2 to S5 and steps S6 to S9 in FIG. 3, respectively.

In the present variation, when the approximate line identification unit 503 identifies the approximate line K in step S24, the approximate line identification unit 503 inputs a command signal to the display unit 72, and causes the display unit 72 to superimpose and display the reference cross section J and the approximate line K of the bucket 23 (step S25).

Next, a worker inputs a command for correcting the approximate line K based on a relative position between the approximate line K and the reference cross section J displayed on the display unit 72 (step S26). At this time, if the display unit 72 (correction command input unit) is a touch panel type display, a worker can operate a correction target portion of the approximate line K displayed on the display unit 72 with a finger to bring the correction target portion close to the reference cross section J. Note that, in another embodiment, a worker may input correction content through the input unit 52 (correction command input unit). The approximate line identification unit 503 can correct a shape of the approximate line K according to the command input to the display unit 72. Information of the corrected approximate line K is stored in the storage unit 507.

As described above, in the present variation, since the display unit 72 can display the approximate line K, a worker can easily grasp a basic shape of the bucket 23 by processing with a small amount of data capacity. Since the approximate line K and the reference cross section J are displayed on the display unit 72 in a superimposed manner, a worker can easily check approximation accuracy of the approximate line K by comparing the approximate line and the reference cross section J displayed on the display unit 72.

Furthermore, in a case where there is a large deviation between the approximate line K and the reference cross section J displayed on the display unit 72, a worker can correct the approximate line K by his or her own will. Therefore, in a case where a large approximation error occurs suddenly, it is possible to prevent erroneous calculation of shape information of the bucket 23. Further, as a worker corrects the approximate line K on his or her own will, a series of processing processes (for example, FIG. 3) requiring a predetermined period of detection time from being executed again.

Figure 10:
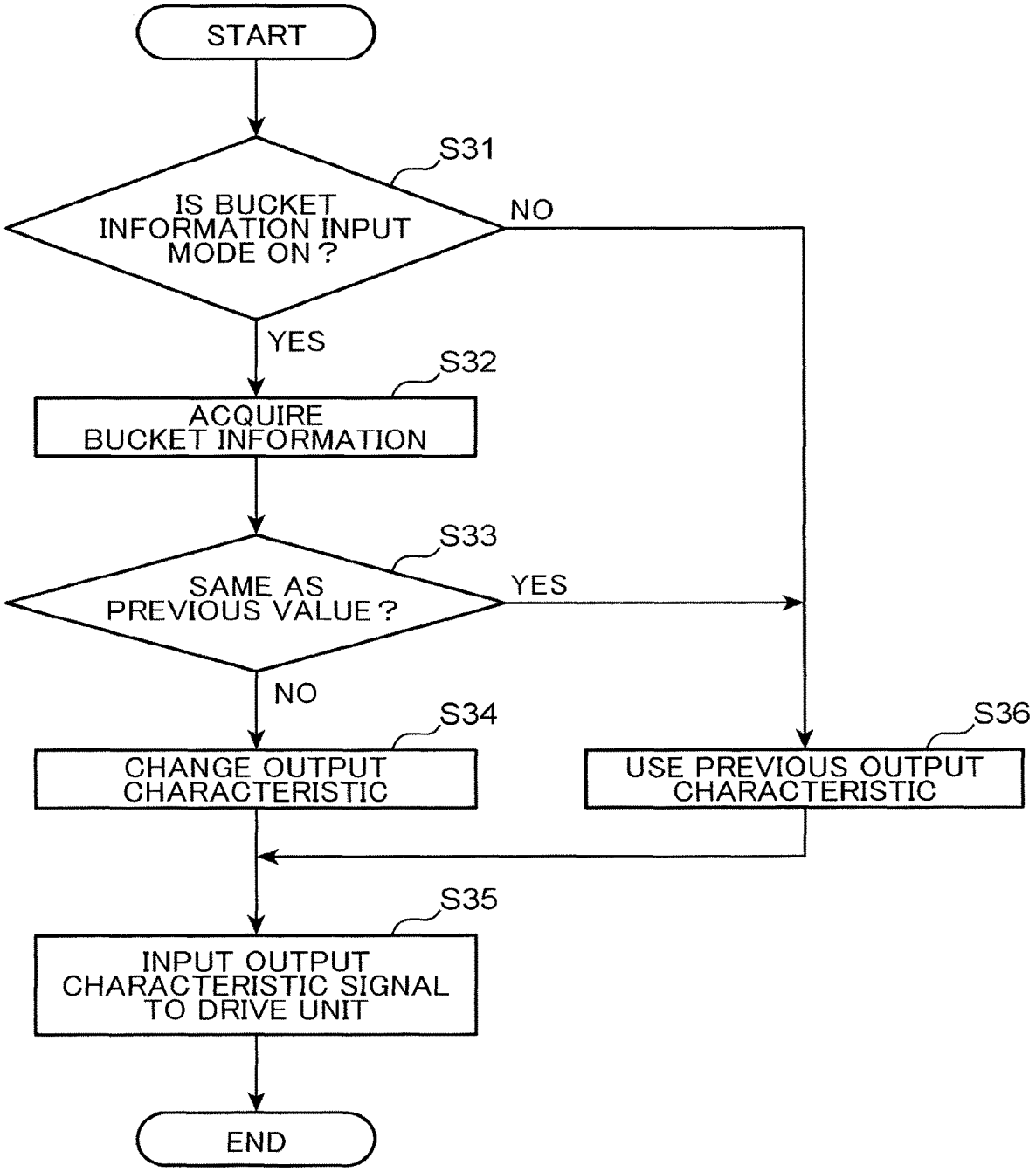
FIG. 10 is a flowchart of the bucket information acquisition processing executed by the bucket information acquisition device according to a variation of the present invention.

FIG. 10 is a flowchart of the bucket information acquisition processing executed by the bucket information acquisition device according to a third variation of the present invention. In the present variation, an output characteristic of the hydraulic excavator 1 can be changed according to shape information of the bucket 23 identified by the approximate line identification unit 503. Referring to FIG. 10, when the output characteristic change processing is started, the determination unit 505 determines whether or not a bucket information input mode is in an ON state. The bucket information input mode is a mode in which a worker inputs a maintenance history, a replacement history, and the like through the input unit 52 in a case where the bucket 23 is removed from a tip of the arm 22 for maintenance or replacement, or the like. In a case where the bucket information input mode is turned on in step S31, since the bucket 23 is replaced, the approximate line identification unit 503 identifies the approximate line K, and the bucket shape calculation unit 504 calculates shape information (bucket shape information) of the bucket 23 (step S32). This step corresponds to, for example, all steps in FIG. 3.

Next, the determination unit 505 compares previous bucket shape information (the approximate line K, the accommodation cross sectional area S, the width dimension W, and the bucket capacity V) stored in the storage unit 507 with the bucket shape information acquired in step S32 (step S33). Here, in a case where the previous bucket shape information is different from the new bucket shape information (NO in step S33), the output characteristic setting unit 506 (FIG. 2) (output characteristic signal input unit) changes the output characteristic (step S34) and inputs an output characteristic signal to the drive unit 71 (step S35). The output characteristic signal is set corresponding to the acquired new bucket shape information. For example, in a case where the accommodation cross sectional area S and the bucket capacity V of the bucket 23 are relatively large through replacement work, a maximum weight of earth and sand accommodated in the bucket 23 also increases, and thus the output characteristic setting unit 506 increases output of the drive unit 71.

Note that, in a case where the bucket information input mode is OFF in step S31 (NO in step S31) and in a case where the bucket shape information is the same as that acquired previously in step S33 (YES in step S33), the output characteristic setting unit 506 uses a previous output characteristic (step S36) and inputs an output characteristic signal corresponding to the output characteristic to the drive unit 71 (step S35).

As described above, in the present variation, since output of the hydraulic excavator 1 can be adjusted according to bucket shape information calculated by the bucket shape calculation unit 504, it is possible to prevent output of the hydraulic excavator 1 from becoming insufficient or excessive with respect to a shape and a work amount of the bucket 23. As a result, an energy saving effect of the hydraulic excavator 1 can be enhanced.

Figure 11:
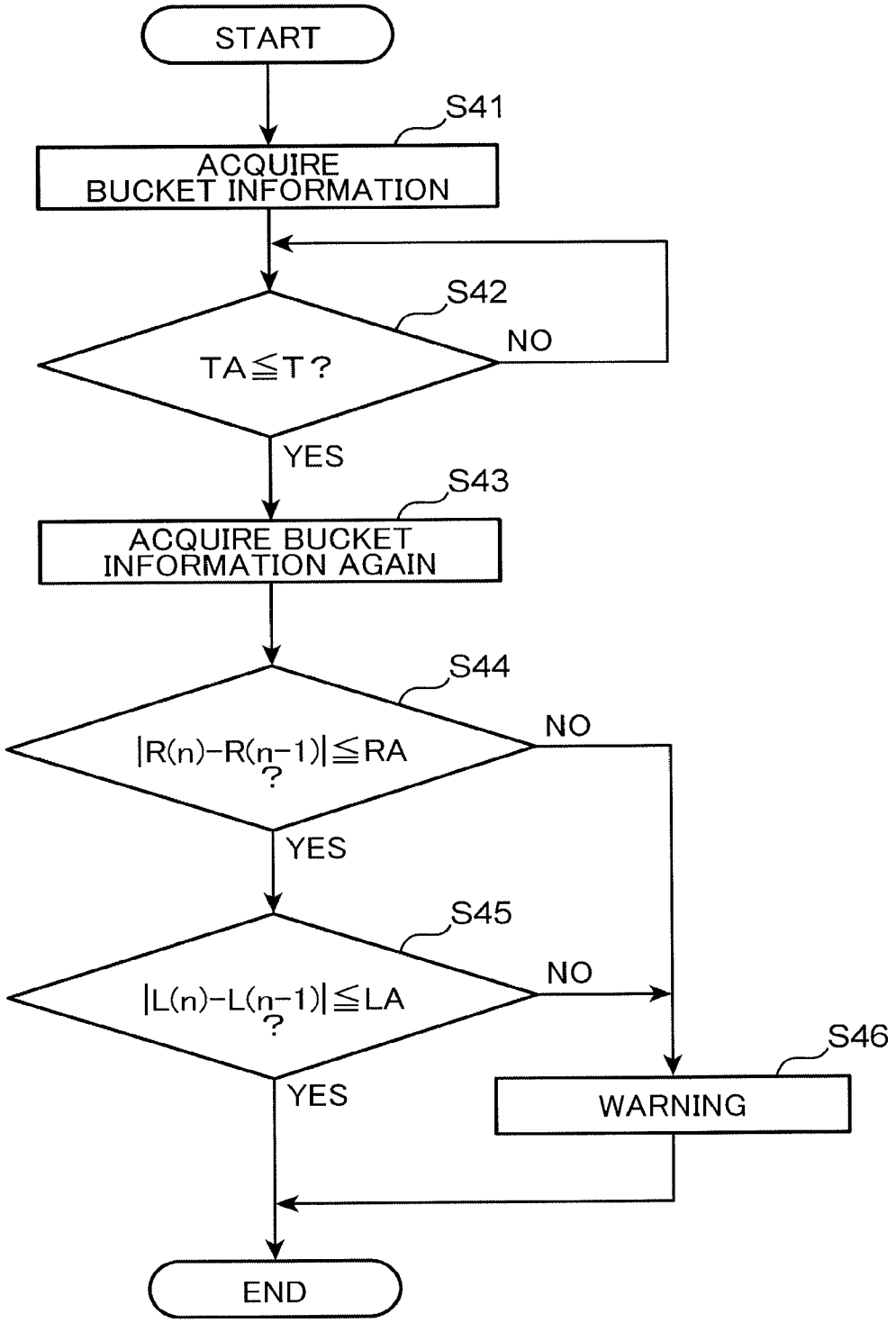
FIG. 11 is a flowchart of the bucket information acquisition processing executed by the bucket information acquisition device according to a variation of the present invention.

FIG. 11 is a flowchart of the bucket information acquisition processing executed by the bucket information acquisition device according to a fourth variation of the present invention. In the present variation, bucket shape information such as a dimension of the approximate line K is acquired at a predetermined cycle, and, when there is a large change in the information, a worker is notified of warning information. As illustrated in FIG. 11, when the bucket information acquisition processing is started, similarly to the process of FIG. 3, the approximate line identification unit 503 identifies the approximate line K, and the bucket shape calculation unit 504 calculates bucket shape information (step S41 in FIG. 11). The storage unit 507 stores the acquired bucket shape information (such as the approximate line K).

Next, the determination unit 505 determines whether or not time T elapsed from acquisition of the bucket shape information described above exceeds a preset threshold TA (step S42). Here, in a case where the time T does not reach the threshold TA (NO in step S42), the processing returns to step S42. On the other hand, in a case where the time T reaches the threshold TA (YES in step S42), the approximate line identification unit 503 and the bucket shape calculation unit 504 acquire bucket shape information again similarly to the process of FIG. 3 (step S43 in FIG. 11). As described above, in the present variation, the approximate line identification unit 503 and the bucket shape calculation unit 504 acquire the bucket shape information at a predetermined cycle. The threshold TA (cycle) is preferably set according to a condition of a work site, and, as an example, is set to one day, one week, half a year, or the like.

Next, the determination unit 505 compares the bucket shape information acquired in steps S41 and S43. Specifically, the determination unit 505 first determines whether or not an absolute value (deviation amount) of a difference (R(n)−R(n−1)) in the curvature radius R of the approximate line K acquired in both steps is equal to or less than a preset threshold RA (step S44). Here, in a case where the absolute value described above exceeds the threshold RA (NO in step S44), the bucket shape calculation unit 504 (warning signal output unit) outputs a warning signal to the notification unit 74. As a result, the notification unit 74 notifies warning information (step S46).

On the other hand, in a case where the absolute value described above is equal to or less than the threshold RA in step S44 (YES in step S44), the determination unit 505 determines whether an absolute value (deviation amount) of a difference (L(n)−L(n−1)) in length of a straight line portion L of the approximate line K acquired in both steps is equal to or less than a preset threshold LA (step S45). Note that step S45 is executed in each of the bottom plate upper straight line portion AD (FIG. 5) and the bottom plate lower straight line portion BE. Here, in a case where the absolute value described above exceeds the threshold LA (NO in step S45), the determination unit 505 (warning signal output unit) outputs a warning signal to the notification unit 74. As a result, the notification unit 74 notifies warning information (step S46). In step S45, in a case where the absolute value described above is equal to or less than the threshold LA (YES in step S45), the bucket shape calculation unit 504 ends the bucket information acquisition processing.

As described above, in the present variation, in a case where there is a possibility that the bucket 23 is worn, deformed, broken, damaged, or the like, the fact can be promptly notified to a worker.

Note that the storage unit 507 may store all pieces of bucket shape information in the past or may perform overwriting processing while leaving a predetermined history. Further, acquired bucket shape information may be transmitted to a management device (server) or the like at a remote location as described later.

Figure 12:
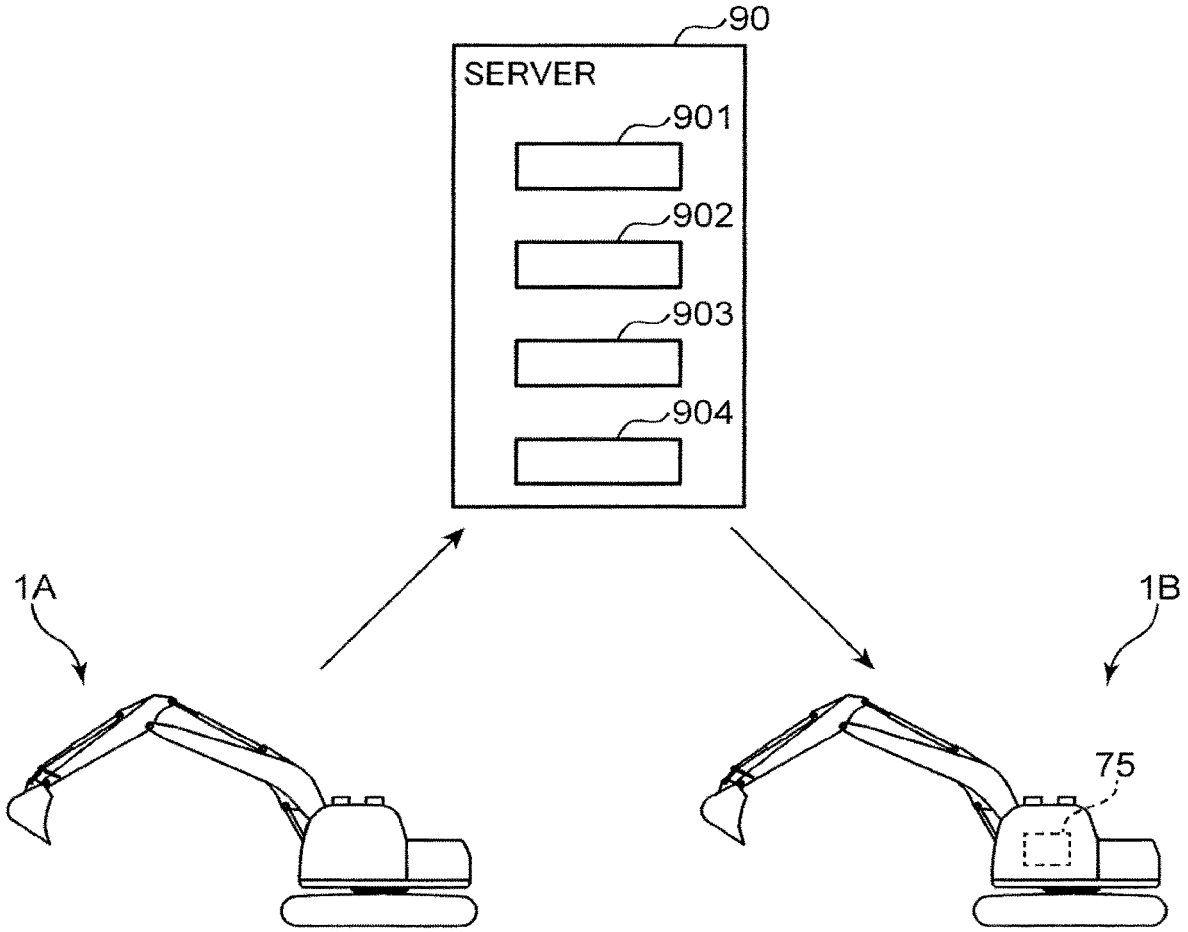
FIG. 12 is a schematic diagram of the construction machine and a management device according to the variation of the present invention.

FIG. 12 is a schematic diagram of the hydraulic excavator 1 and the server 90 (management device) according to a fifth variation of the present invention. In the present variation, information acquired by the approximate line identification unit 503 and the bucket shape calculation unit 504 is transmitted to the server 90. The server 90 is arranged in a data center, a remote management center, or the like installed at a place away from a work site.

Referring to FIG. 12, the server 90 includes a server side receiving unit 901, a server side output characteristic setting unit 902, a server side storage unit 903, and a server side transmission unit 904.

In the present variation, when the approximate line identification unit 503 and the bucket shape calculation unit 504 acquire the bucket shape information as illustrated in FIG. 3, the main body position information acquisition unit 62 (FIG. 2) acquires the latest position information of the hydraulic excavator 1 at a work site.

Next, the transmission unit 73 (FIG. 2) associates position information of the hydraulic excavator 1 and the bucket shape information with each other and transmits them to the server 90. When the server side receiving unit 901 in the server 90 receives the information, the server side storage unit 903 stores these pieces of information in association with each other.

As described above, in the present embodiment, the server 90 can acquire and accumulate bucket shape information and position information at a work site acquired by the hydraulic excavator 1. For this reason, as illustrated in FIG. 12, the server 90 can grasp a hydraulic excavator having what work ability and shape of the bucket 23 works at what position and region based on information acquired from a hydraulic excavator 1A (one construction machine). As a result, the server 90 can instruct appropriate work content (work position and work amount) from the server side transmission unit 904 to a receiving unit 75 of a hydraulic excavator 1B (another construction machine) different from the hydraulic excavator 1A. For example, if work ability of the hydraulic excavator 1A is sufficient for work content at a current work position, the hydraulic excavator 1B can be guided to another work site. On the other hand, in a case where work ability of the hydraulic excavator 1A is insufficient for work content at a current work position, the hydraulic excavator 1B can be caused to assist work of the hydraulic excavator 1A.

Further, as the server side storage unit 903 of the server 90 is used in this manner, position information of the hydraulic excavator 1 at a plurality of work sites and shape information of the bucket 23 can be accumulated by a storage unit having larger capacity than the storage unit 507 of the hydraulic excavator 1.

Note that the present invention is not limited to the above-described embodiments, and a variation below can be further employed.

(1) In the above embodiment, description is made in an aspect in which a curve portion of the approximate line K is formed of an arc, but the curve portion may be another curve instead of an arc. Further, the curve portion may be one in which two or more curves (arcs) are connected.

(2) In the above embodiment, description is made in an aspect in which the reference cross section J is located at a central portion in a width direction (left-right direction) of the bucket 23, but a position of the reference cross section J is not limited to the central portion.

(3) Regarding identification of the approximate line K, patterns of a plurality of the approximate lines K may be stored in advance in the storage unit 507, and the approximate line K that best matches the reference cross section J may be extracted and identified from among the patterns. At this time, a stored pattern of the approximate line K may be enlarged or reduced in size and compared with the reference cross section J.

Provided by the present invention is a bucket information acquisition device for acquiring information regarding the shape of a bucket in a construction machine. The bucket rotates about a rotational center axis along a predetermined moving plane. The bucket information acquisition device includes a distance distribution acquisition unit, a reference cross section extraction unit, an approximate line identification unit, and a bucket shape calculation unit. The distance distribution acquisition unit acquires three-dimensional distance distribution of the bucket with respect to a reference point. The reference cross section extraction unit extracts a reference cross section, which is a cross section of the bucket obtained by cutting the bucket along a plane parallel to the moving plane, from the distance distribution acquired by the distance distribution acquisition unit. The approximate line identification unit identifies an approximate line including a straight line and a curve and approximate to the reference cross section based on the reference cross section. The bucket shape calculation unit calculates bucket shape information, which is information regarding a shape of the bucket, based on the approximate line.

According to the present configuration, the approximate line identification unit can identify an approximate line from a reference cross section, and the bucket shape calculation unit can calculate bucket shape information based on the approximate line. Since a data amount of information of an approximate line is small as compared with that of three-dimensional distance distribution (three-dimensional data) acquired by the distance distribution acquisition unit, it is possible to acquire bucket shape information attached to a construction machine while reducing a data amount and a processing load handled by the bucket shape calculation unit as compared with a case where shape information of a bucket is directly calculated based on the three-dimensional distance distribution.

In the above configuration, the approximate line identification unit desirably identifies the approximate line such that the approximate line includes a pair of line segments and at least one curve connecting the pair of line segments.

According to the present configuration, since the approximate line identification unit identifies an approximate line by a pair of line segments and one or more curves, a data amount of the approximate line can be reduced as compared with a case where an approximate line is identified by more line segments or a case where an approximate line is identified as a set of points.

In the above configuration, the at least one curve desirably includes at least one arc, and the bucket shape calculation unit desirably calculates a length of each of the pair of line segments and a curvature radius of the at least one arc as the bucket shape information.

According to the present configuration, it is possible to identify a shape of a bucket based on simple information such as a length of a pair of line segments constituting an approximate line and a curvature radius of an arc.

In the above configuration, it is desirable to further include a drive command input unit that inputs a drive command signal to a bucket drive unit included in the construction machine and capable of rotating the bucket about the rotational center axis, the drive command signal causing the bucket to sequentially take a plurality of postures different from each other with respect to ground, and the bucket shape calculation unit desirably calculates a relative position of the rotational center axis with respect to the reference point as the bucket shape information based on the approximate line identified in each of a plurality of the postures set by the bucket drive unit.

According to the present configuration, a position of a rotational center axis can be easily grasped based on a plurality of postures of a bucket. Further, since a movable range of a tip of a bucket when the bucket rotates can be grasped, it is possible to accurately avoid collision of the bucket with a surrounding object.

In the above configuration, a plurality of the postures desirably include at least three postures, and the bucket shape calculation unit desirably calculates a center position of one arc passing through a tip of at least three of the approximate lines corresponding to the at least three postures as the relative position of the rotational center axis.

According to the present configuration, a position of a rotational center axis can be grasped using a track of a tip of an approximate line at the time of rotation.

In the above configuration, the bucket shape calculation unit desirably calculates, as the bucket shape information, an accommodation cross sectional area that is an area of a region surrounded by a line segment connecting a tip of the approximate line and a base end opposite to the tip and the approximate line.

According to the present configuration, it is possible to easily grasp basic accommodation capacity of a bucket while reducing a processing load of the bucket shape calculation unit.

In the above configuration, the bucket shape calculation unit desirably calculates a width dimension that is a dimension of the bucket in the left-right direction from distance distribution acquired by the distance distribution acquisition unit, and calculates accommodation volume of the bucket as the bucket shape information from the accommodation cross sectional area and the width dimension.

According to the present configuration, it is possible to accurately grasp earth and sand accommodation capacity of a bucket while reducing a processing load of the bucket shape calculation unit.

In the above configuration, the bucket shape calculation unit desirably calculates a relative position of a pair of left and right side walls of the bucket with respect to the reference point from the distance distribution, calculates a relative position of a centroid of a region surrounded by a line segment connecting the tip and the base end and the approximate line with respect to the reference point, and calculates, as the width dimension, a distance between a pair of left and right intersections where a straight line passing through the centroid and extending in the left-right direction intersects the pair of left and right side walls.

According to the present configuration, a processing load of the bucket shape calculation unit can be further reduced as compared with a case where a width dimension is calculated directly using three-dimensional data.

In the above configuration, it is desirable to further include an output characteristic signal input unit that inputs, to the construction machine, an output characteristic signal for changing an output characteristic of the construction machine according to the bucket shape information calculated by the bucket shape calculation unit.

According to the present configuration, it is possible to prevent output of a construction machine from becoming insufficient or excessive with respect to a shape and a work amount of a bucket. As a result, an energy saving effect of a construction machine can be enhanced.

In the above configuration, the bucket shape calculation unit is desirably capable of calculating the bucket shape information at a predetermined cycle, and it is desirable to further include a storage unit that stores the bucket shape information calculated by the bucket shape calculation unit, a determination unit that determines a deviation amount between past bucket shape information stored in the storage unit and new bucket shape information calculated by the bucket shape calculation unit, and a warning signal output unit that outputs a warning signal in a case where a deviation amount between the past bucket shape information and the new bucket shape information exceeds a preset threshold by the determination unit.

According to the present configuration, in a case where there is a possibility that the bucket is worn, deformed, broken, damaged, or the like, the fact can be promptly notified to a worker.

In the above configuration, it is desirable to further include a display unit capable of displaying the approximate line identified by the approximate line identification unit.

According to the present configuration, a worker can easily grasp a basic shape of a bucket by checking the display unit.

In the above configuration, the display unit is further desirably capable of displaying the approximate line and the reference cross section in a superimposed manner.

According to the present configuration, a worker can easily check approximation accuracy of an approximate line by comparing the approximate line and the reference cross section displayed on the display unit.

In the above configuration, a correction command input unit capable of receiving a command for correcting the approximate line according to a relative position between the approximate line displayed on the display unit and the reference cross section may be further included, and the approximate line identification unit may be capable of correcting a shape of the approximate line according to the command input to the correction command input unit.

According to the present configuration, in a case where there is a large deviation between an approximate line and a reference cross section displayed on the display unit, a worker can correct the approximate line by his or her own will. Therefore, in a case where a large error suddenly occurs in identification of an approximate line, it is possible to prevent calculation of shape information of a bucket a state where the error is included.

In the above configuration, it is desirable to further include a position information acquisition unit that acquires position information of the construction machine at a work site, and a transmission unit that transmits the position information and the bucket shape information in association with each other to a management device arranged at a position away from the construction machine.

According to the present configuration, the management device can acquire and accumulate position information and bucket shape information of a construction machine. For this reason, the management device can grasp a construction machine having what work ability and shape of a bucket works at what position and region based on information acquired from the construction machine.

Also provided by the present invention is a construction machine. The construction machine includes a machine body, a derricking body that has a tip portion and is supported by the machine body in a derrickable manner, a bucket rotatably supported by the tip portion of the derricking body about a rotational center axis extending in a left-right direction, and the bucket information acquisition device described any of the above capable of acquiring bucket shape information that is information regarding a shape of the bucket.

According to the present configuration, it is possible to acquire shape information of a bucket while reducing a data amount and a processing load handled by the bucket shape calculation unit as compared with a case where shape information of a bucket is directly calculated based on three-dimensional distance distribution.

According to the present invention, there is provided a bucket information acquisition device capable of acquiring bucket shape information while reducing a data amount to be handled and a processing load as compared with a case where bucket shape information is directly calculated from three-dimensional data, and a construction machine including the bucket information acquisition device.

The invention claimed is:

1. A bucket information acquisition device that acquires information regarding a shape of a bucket that rotates about a rotational center axis along a predetermined moving plane in a construction machine, the bucket information acquisition device comprising a processor configured to function as:

a distance distribution acquisition unit that has a reference point and acquires three-dimensional distance data of the bucket with respect to the reference point, the three-dimensional distance data being distribution data of distances between the reference point and a plurality of measurement points of the bucket;

a reference cross section extraction unit that extracts two-dimensional data of a reference cross section, which is a cross section of the bucket obtained by cutting the bucket along a plane parallel to the moving plane, from the three-dimensional distance data acquired by the distance distribution acquisition unit, based on the distribution data of distances between the reference point and a plurality of measurement points of the bucket;

an approximate line identification unit that identifies, based on the reference cross section, an approximate line that includes a straight line and a curve and is approximate to the two-dimensional data of the reference cross section; and a bucket shape calculation unit that calculates a shape of the approximate line as one type of bucket shape information, which is information regarding a shape of the bucket, based on the approximate line.

2. The bucket information acquisition device according to claim 1, wherein the approximate line identification unit identifies the approximate line such that the approximate line includes a pair of line segments and at least one curve connecting the pair of line segments.

3. The bucket information acquisition device according to claim 2, wherein the at least one curve includes at least one arc, and the bucket shape calculation unit calculates a length of each of the pair of line segments and a curvature radius of the at least one arc as the bucket shape information.

4. The bucket information acquisition device according to claim 1, wherein the processor is further configured to function as a drive command input unit that is connected to a bucket drive unit included in the construction machine and capable of rotating the bucket about the rotational center axis, the drive command input unit inputting a drive command signal to the bucket drive unit, the drive command signal causing the bucket to sequentially take a plurality of postures different from each other with respect to ground, wherein the bucket shape calculation unit calculates a relative position of the rotational center axis with respect to the reference point as the bucket shape information based on the approximate line identified in each of the plurality of postures set by the bucket drive unit.

5. The bucket information acquisition device according to claim 4, wherein the plurality of postures include at least three postures, and the bucket shape calculation unit calculates a center position of one arc passing through a tip of at least three of the approximate lines corresponding to the at least three postures as the relative position of the rotational center axis.

6. The bucket information acquisition device according to claim 1, wherein the bucket shape calculation unit calculates, as the bucket shape information, an accommodation cross sectional area that is an area of a region surrounded by a line segment connecting a tip of the approximate line and a base end opposite to the tip and the approximate line.

7. The bucket information acquisition device according to claim 6, wherein the bucket shape calculation unit calculates a width dimension that is a dimension of the bucket in a left-right direction from the three-dimensional distance data acquired by the distance distribution acquisition unit, and calculates accommodation volume of the bucket as the bucket shape information from the accommodation cross sectional area and the width dimension.

8. The bucket information acquisition device according to claim 7, wherein the bucket shape calculation unit calculates a relative position of a pair of left and right side walls of the bucket with respect to the reference point from the three-dimensional distance data, calculates a relative position of a centroid of a region surrounded by a line segment connecting the tip and the base end and the approximate line with respect to the reference point, and calculates, as the width dimension, a distance between a pair of left and right intersections where a straight line passing through the centroid and extending in the left-right direction intersects the pair of left and right side walls.

9. The bucket information acquisition device according to claim 1, wherein the processor is further configured to function as an output characteristic signal input unit that is connected to a drive unit provided in the construction machine, the drive unit being used for driving the construction machine, the output characteristic signal input unit inputs, to the drive unit, an output characteristic signal for changing an output characteristic of the construction machine according to the bucket shape information calculated by the bucket shape calculation unit.

10. The bucket information acquisition device according to claim 1, wherein the bucket shape calculation unit is capable of calculating the bucket shape information at a predetermined cycle, the bucket information acquisition device further comprising:

a storage unit that is composed of a storage and stores the bucket shape information calculated by the bucket shape calculation unit; and the processor is further configured to function as a determination unit that determines whether or not a deviation amount between past bucket shape information stored in the storage unit and new bucket shape information calculated by the bucket shape calculation unit is equal to less than a preset threshold; and a warning signal output unit that is connected to a notification unit provided in the construction machine, the notification unit being used for notifying a worker of predetermined notification information, the warning signal output unit outputs, to the notification unit, a warning signal in a case where a deviation amount between the past bucket shape information and the new bucket shape information exceeds the preset threshold by the determination unit.

11. The bucket information acquisition device according to claim 1, further comprising a display unit capable of displaying the approximate line identified by the approximate line identification unit.

12. The bucket information acquisition device according to claim 11, wherein the display unit is capable of displaying the approximate line and the reference cross section in a superimposed manner.

13. The bucket information acquisition device according to claim 12, further comprising a correction command input unit capable of receiving a command for correcting the approximate line according to a relative position between the approximate line displayed on the display unit and the reference cross section, wherein the approximate line identification unit is capable of correcting a shape of the approximate line according to the command input to the correction command input unit.

14. The bucket information acquisition device according to claim 1, further comprising:

a position information acquisition unit that acquires position information of the construction machine at a work site; and a transmission unit that is communicably connected to a management device arranged at a position away from the construction machine, the transmission unit transmits the position information and the bucket shape information in association with each other to the management device.

15. A construction machine comprising:

a machine body;

a derricking body that has a tip portion and is supported by the machine body in a derrickable manner;

a bucket rotatably supported by the tip portion of the derricking body about a rotational center axis extending in a left-right direction; and a bucket information acquisition device capable of acquiring bucket shape information that is information regarding a shape of the bucket, the bucket information acquisition device comprising a processor configured to function as:

a distance distribution acquisition unit that has a reference point and acquires three-dimensional distance data of the bucket with respect to the reference point, the three-dimensional distance data being distribution data of distances between the reference point and a plurality of measurement points of the bucket;

a reference cross section extraction unit that extracts two-dimensional data of a reference cross section, which is a cross section of the bucket obtained by cutting the bucket along a plane parallel to the moving plane, from the three-dimensional distance data acquired by the distance distribution acquisition unit, based on the distribution data of distances between the reference point and a plurality of measurement points of the bucket;

an approximate line identification unit that identifies, based on the reference cross section, an approximate line that includes a straight line and a curve and is approximate to the two-dimensional data of the reference cross section; and a bucket shape calculation unit that calculates a shape of the approximate line as one type of bucket shape information, which is information regarding a shape of the bucket, based on the approximate line.

* * * * *